US005122809A

United States Patent [19]

Haruyama et al.

[11] Patent Number: 5,122,809

[45] Date of Patent: Jun. 16, 1992

[54] MICROWAVE ELECTRIC POWER RECEIVER

[75] Inventors: Shinichi Haruyama, Gunma; Masao Tomiyama, Ibaraki; Yoshikazu Kawashima; Hiroaki Kojima, both of Kanagawa, all of Japan

[73] Assignees: Yamatake-Honeywell Co., Ltd; Yokowo Mfg. Co., Ltd., both of Tokyo, Japan

[21] Appl. No.: 752,183

[22] Filed: Aug. 23, 1991

Related U.S. Application Data

[63] Continuation of Ser. No. 502,300, Mar. 30, 1991, abandoned.

[30] Foreign Application Priority Data

Apr. 3, 1989 [JP] Japan ..... 1-84591

[51] Int. Cl.[5] ..... H01Q 9/20

[52] U.S. Cl. ..... 343/700 MS; 333/247; 343/701; 343/797

[58] Field of Search ..... 333/219, 222, 246, 247; 343/700 MS, 793, 795, 797, 807, 820, 822, 701; 455/327, 330

[56] References Cited

U.S. PATENT DOCUMENTS

| | | | |
|---|---|---|---|
| 3,041,539 | 6/1962 | Parker | 343/701 X |
| 3,475,700 | 10/1969 | Ertel | 333/104 |
| 3,852,755 | 12/1974 | Works et al. | 343/701 |
| 4,008,477 | 2/1977 | Babij et al. | 343/701 |
| 4,198,641 | 4/1980 | Gibson | 343/797 |
| 4,218,685 | 8/1980 | Ellis, Jr. | 343/797 X |
| 4,281,293 | 7/1981 | Childs et al. | 455/327 X |
| 4,853,705 | 8/1989 | Landt | 343/701 X |
| 5,030,962 | 7/1991 | Rees | 343/700 MS |

OTHER PUBLICATIONS

Thourel, *The Antenna*, Chapman & Hall, London, England, 1960, title page & p. 105.

*Primary Examiner*—Paul Gensler

*Attorney, Agent, or Firm*—Blakely, Sokoloff, Taylor & Zafman

[57] ABSTRACT

In a microwave electric power receiver, a microstrip resonator having a line length ½ of a wavelength of a microwave to be received is notched to be split at its longitudinally central portion into two portions. A rectification diode is interposed between notched end portions of the microstrip resonator portions to be matched therewith. The diode generates a DC power.

4 Claims, 3 Drawing Sheets

MICROWAVE ELECTRIC POWER RECEIVER

This is a continuation of application Ser. No. 502,300 filed Mar. 30, 1991, now abandoned.

BACKGROUND OF THE INVENTION

The present invention relates to a microwave electric power receiver for generating a DC power based on an electric power of a received microwave.

A technique for obtaining a DC power of a receiver from an electric power of a received microwave without arranging an operation power source in the receiver itself is disclosed in Japanese Patent Laid-Open No. 63-54023. The technique described in this patent will be briefly described below. A rectification diode is connected to one side of a rectangular microstrip resonator having a line length ½ of a wavelength λ of a received microwave, and generates a DC power of a receiver from an electric power of a received microwave. In the technique described in the patent, one end of the diode is directly connected to the microstrip resonator. However, as is well known, in order to efficiently obtain a DC power, the microstrip resonator and the diode must be matched with each other.

Thus, an actual circuit arrangement employs a microstrip line for matching, as shown in FIG. 4. More specifically, one end of a matching microstrip line 2 is connected to one side of a rectangular microstrip resonator 1 having a λ/2 line length, and the other end of the line is connected to one end (e.g., cathode) of a rectification diode 3. The one end of the diode 3 is connected to an output terminal 5 through a choke coil 4 for removing a high frequency component. The other end (e.g., anode) of the diode 3 is grounded through another choke coil 6.

In this arrangement, the microstrip resonator 1 and the diode 3 are matched with each other by the microstrip line 2, and an electric power of a microwave received by the microstrip resonator 1 is relatively efficiently rectified by the diode 3. Thus, a DC power is generated at the output terminal 5.

As described above, in the technique for matching the microstrip resonator 1 and the diode 3 using the microstrip line 2, an electric power of a microwave transmitted to the diode 3 is efficiently rectified by the diode 3. However, the electric power is attenuated more or less by a transmission loss while it is transmitted from the microstrip resonator 1 to the diode 3. Therefore, a DC power cannot be obtained by a sufficient electric power due to this attenuation.

SUMMARY OF THE INVENTION

It is therefore an object of the present invention to provide a microwave electric power receiver which can efficiently generate a DC power free from attenuation.

It is another object of the present invention to provide a microwave electric power receiver which can receive a circularly polarized microwave.

In order to achieve the above objects, there is provided a microwave electric power receiver for generating a DC power from a microwave received by a microstrip resonator having a line length ½ of a wavelength of the microwave wherein the microstrip resonator is notched to be split at a longitudinally central portion thereof into two portions and a rectification diode is interposed between notched end portions of the microstrip resonator portions to be matched therewith.

DESCRIPTION OF THE PREFERRED EMBODIMENTS

Figure 1:
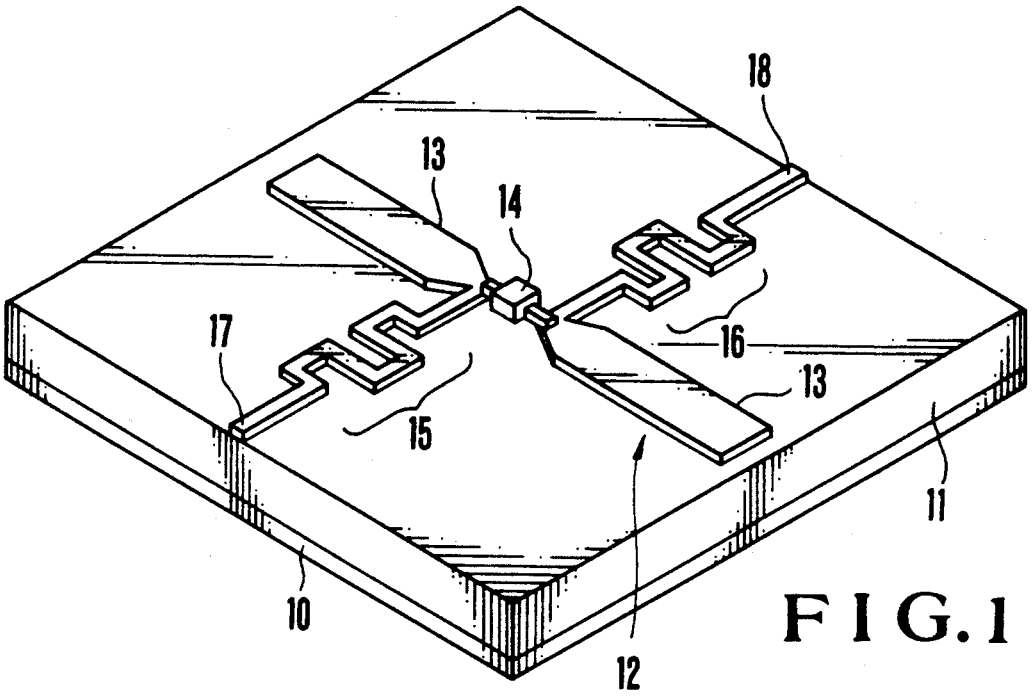
FIG. 1 is a perspective view of an outer appearance of a microwave electric power receiver according to the present invention.

An embodiment of the present invention will be described below with reference to FIGS. 1 and 2. FIG. 1 shows an outer appearance of a microwave electric power receiver according to the present invention, and FIG. 2 shows a detailed circuit arrangement of the receiver shown in FIG. 1.

Figure 2:
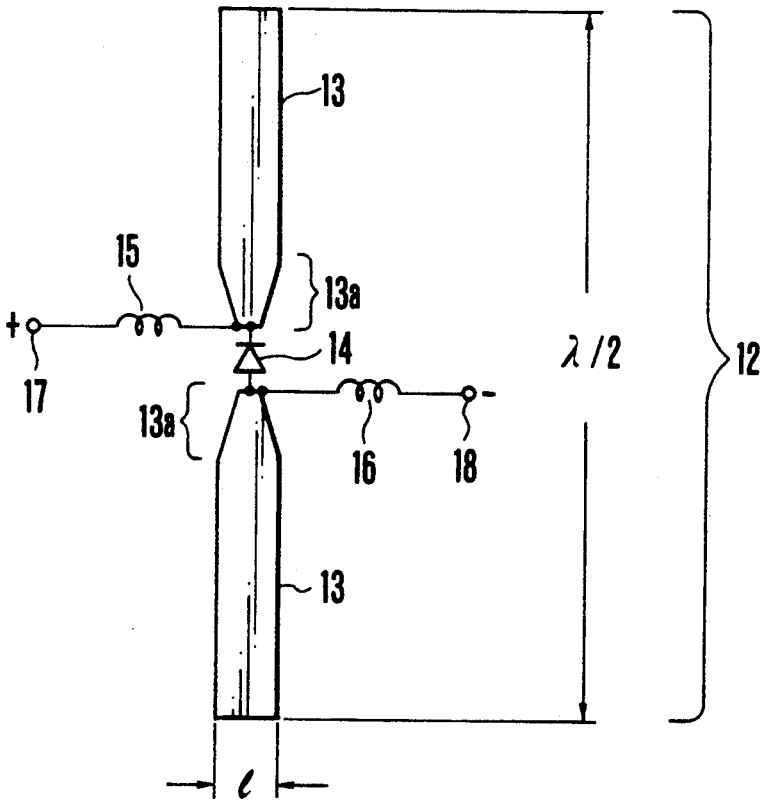
FIG. 2 is a circuit diagram of the receiver shown in FIG. 1.

In FIGS. 1 and 2, a microstrip resonator 12 having a line length ½ of a wavelength λ of a microwave to be received is arranged on the upper surface of a dielectric substrate 11 on a lower surface of which a ground plate 10 is disposed. A width l of the microstrip resonator 12 can be considerably smaller than the line length. The microstrip resonator 12 is notched at its longitudinally central portion to be split into two portions 13. The notched end portion of each portion 13 is formed into a tapered portion 13*a* which is tapered toward the distal end. A rectification diode 14 such as a Schottky diode is interposed between the notched end portions. Output terminals 17 and 18 extend from the notched end portions through choke coils 15 and 16, respectively. The widths of the tapered portions 13*a* of the notched end portions are determined to match the two split microstrip resonator portions 13 with the diode 14. In FIG. 1, the choke coils 15 and 16 and the output terminals 17 and 18 are formed by microstrip lines simultaneously with the microstrip resonator 12.

Figure 4:
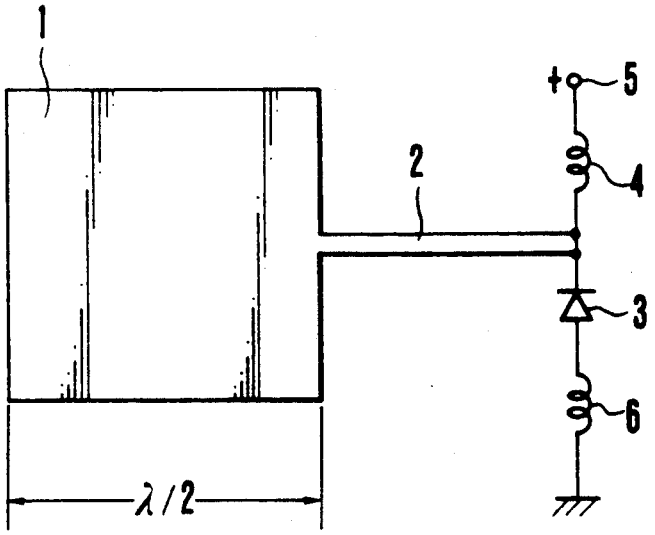
FIG.4 PRIOR ART
FIG. 4 is a circuit diagram of a conventional microwave electric power receiver using a matching microstrip line.

With this arrangement, the microstrip resonator 12 resonates a microwave having the wavelength λ on a plane of polarization in the longitudinal direction of the microstrip resonator 12, and the central portion of the microstrip resonator 12 serves as a current antinode. Thus, a potential difference according to a current to be flowed as a current antinode is generated between the notched end portions of the two split microstrip resonator portions 13, and is rectified by the diode 14. As a result, a DC voltage is generated across the cathode and the anode of the diode 14. High-frequency components are removed by the choke coils 15 and 16, and a DC voltage as a power of the receiver is generated across the output terminals 17 and 18. Since no microstrip line is required to match the microstrip resonator 12 with the diode 14 unlike in the prior art shown in FIG. 4, an electric power of a received microwave can be efficiently converted to a DC voltage accordingly without any transmission loss.

In order to match the two split microstrip resonator portions 13 with the diode 14, the present invention is not limited to a structure wherein tapered portions 13*a* are formed on the notched end portions For example, the total length of the microstrip resonator 12 may be determined to match with the diode 14.

Figure 3:
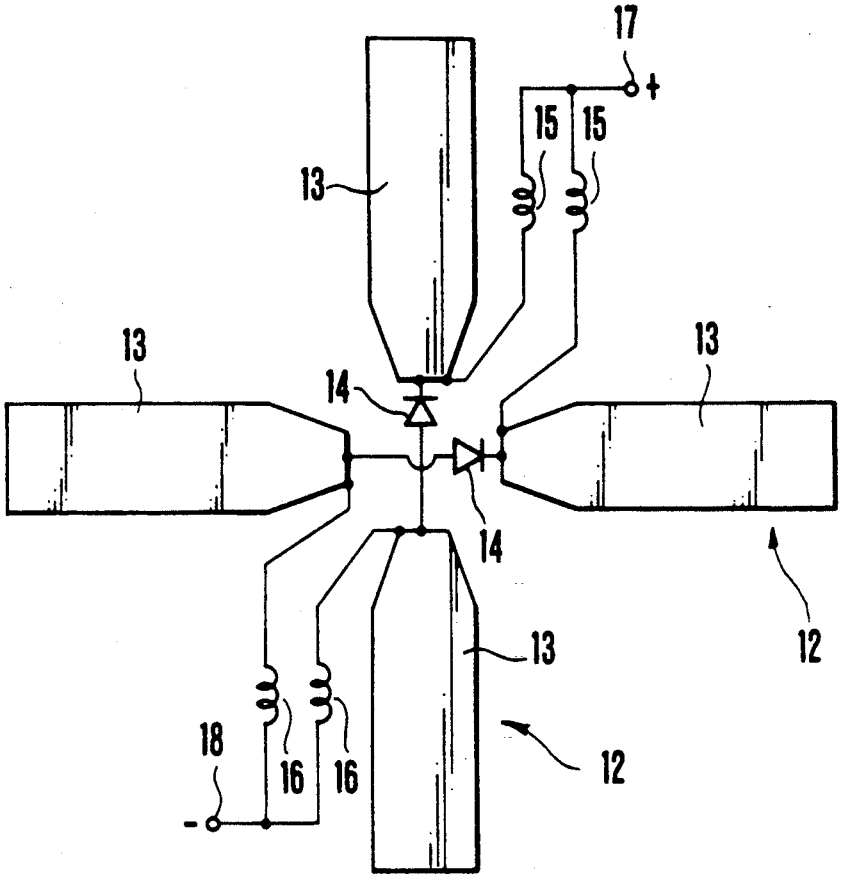
FIG. 3 is a circuit diagram of another embodiment of a microwave electric power receiver which can receive a circularly polarized microwave, wherein the diodes are connected in parallel.

FIG. 3 shows another embodiment of a microwave electric power receiver according to the present invention, which can receive a circularly polarized microwave. The same reference numerals in FIG. 3 denote the same or equivalent parts in FIGS. 1 and 2, and a repetitive description thereof will be omitted.

In FIG. 3, two microstrip resonators 12 each having a line length ½ of a wavelength λ of a microwave to be received are arranged on the upper surface of a dielectric substrate to be perpendicular to each other in a cross shape. Each of these two microstrip resonators 12 is split into two portions at its longitudinally central portion. Diodes 14 are interposed between the corresponding two-split microstrip resonator portions 13. The cathodes of the diodes 14 are connected to one-end portions of corresponding choke coils 15. The other-end portions of the choke coils 15 are commonly connected to a positive output terminal 17. The anodes of the diodes 14 are connected to one-end portions of corresponding choke coils 16, and the other-end portions of these choke coils 16 are commonly connected to a negative output terminal 18.

With this arrangement, vertical and horizontal components of a circularly polarized microwave are respectively received by the two orthogonal microstrip resonators 12, and DC voltages according to electric powers of the vertical and horizontal components are generated by the diodes 14. Since high-frequency components are removed the choke coils 15 and 16, an average value of the DC voltages generated by the diodes 14 is generated across the output terminals 17 and 18.

Figure 5:
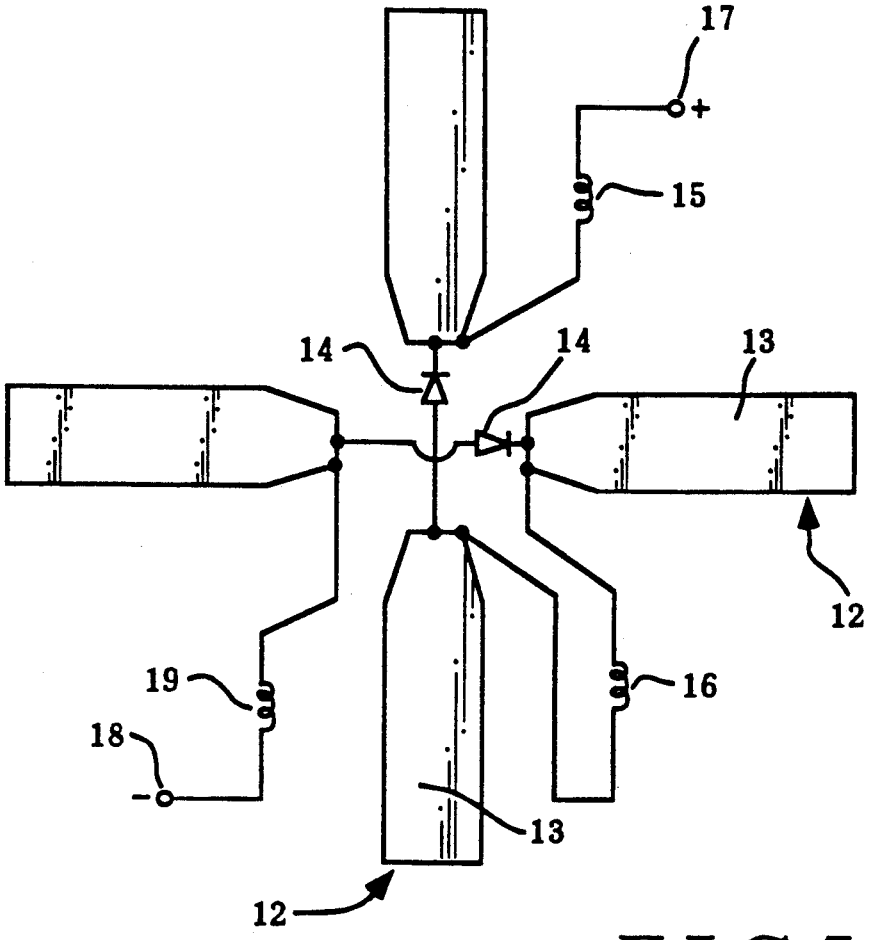
FIG. 5 is a circuit diagram of the receiver shown in FIG. 1, wherein the diodes are connected in series.

In the embodiment shown in FIG. 3, the diodes 14 are connected in parallel with each other. However, the diodes 14 may be connected in series with each other, as shown in FIG. 5. More specifically, the cathode of one diode 14 is connected to the positive output terminal 17 through one choke coil 15, and its anode is connected to the cathode of the other diode 14 through another choke coil 16. The anode of the other diode 14 is connected to the negative output terminal 18 through still another choke coil 19. According to this series connection, a DC voltage twice the average value of the DC voltages generated by the diodes 14 appears across the positive and negative output terminals 17 and 18.

According to the present invention, the following remarkable effects can be provided.

According to one aspect of a microwave electric power receiver, a diode is connected to notched end portions at the central portion of a microstrip resonator in a matched state, and a microwave received by the microstrip resonator is directly supplied to and rectified by the diode. Therefore, an electric power will not be attenuated like conventional receiver using a matching microstrip line, a DC power can be efficiently generated.

According to another aspect of a microwave electric power receiver, since microstrip resonators are arranged to be perpendicular to each other in a cross shape, an electric power of a circularly polarized microwave can be efficiently converted to a DC power.

According to still another aspect of a microwave electric power receiver, since the notched end portion of a microstrip resonator is tapered toward its distal end, easy matching with a diode is attained. In addition, the width of the microstrip resonator may be increased to decrease an impedance, thereby decreasing a transmission loss of the microstrip resonator.

What is claimed is:

1. A microwave electric power receiver for generating a DC power from a received microwave comprising: two microstrip resonators formed on an upper surface of a planar dielectric substrate which includes a ground plate disposed on a lower surface, said microstrip resonators each having a line length ½ of a wavelength of the microwave to be received are arranged perpendicular to each other in a cross shape, each of said two microstrip resonators is split at a longitudinally central portion thereof into two portions, two rectification diodes are interposed respectively between the notched end portions of the corresponding microstrip resonators to be matched therewith; and wherein a choke coil is interposed between a cathode of at least one of the diodes and a positive output terminal and another choke coil is interposed between an anode of at least one of the diodes and a negative output terminal, said choke coils being formed on the dielectric substrate.

2. A microwave electric power receiver accordingly to claim 1, wherein said two diodes are connected in parallel with each other such that a first branch between positive and negative output terminals includes a choke coil, a microstrip resonator portion, a diode, another microstrip resonator portion and another choke coil connected in series, and a second branch connected in parallel with the first branch between positive and negative output terminals includes a choke coil, a microstrip resonator portion, a diode, another microstrip resonator portion and another choke coil connected in series.

3. A microwave electric power receiver according to claim 1, wherein said two diodes are connected in series such that between positive and negative output terminals are connected in series a choke coil, a microstrip resonator portion, a diode, another microstrip resonator portion, another choke coil, another microstrip resonator portion, another diode, another microstrip resonator portion, and another choke coil.

4. A microwave electric power receiver according to claim 1, wherein said notched end portions of said microstrip resonator are tapered toward distal ends thereof to match with said diode.

* * * * *

UNITED STATES PATENT AND TRADEMARK OFFICE

CERTIFICATE OF CORRECTION

PATENT NO. : 5,122,809

DATED : June 16, 1992

INVENTOR(S) : Haruyama et al.

It is certified that error appears in the above-identified patent and that said Letters Patent is hereby corrected as shown below:

In column 3 at line 2 replace "end portions" with --end portions.--;

In claim 2 in column 4 at line 35 replace "receiver accordingly" with --receiver according--.

Signed and Sealed this

Twelfth Day of September, 1995

*Attest:*

Bruce Lehman

BRUCE LEHMAN

*Attesting Officer*

*Commissioner of Patents and Trademarks*